US005279235A

United States Patent [19]

Greco

[11] Patent Number: 5,279,235

[45] Date of Patent: Jan. 18, 1994

[54] VALVE ACTUATION MECHANISM FOR INCINERATOR

[75] Inventor: Richard Greco, Matawan, N.J.

[73] Assignee: Air Technologies, Inc., Palatine, Ill.

[21] Appl. No.: 911,545

[22] Filed: Jul. 9, 1992

Related U.S. Application Data

[63] Continuation of Ser. No. 728,198, Jul. 10, 1991, Pat. No. 5,129,332.

[51] Int. Cl.[5] ..... F23B 7/00

[52] U.S. Cl. ..... 110/233; 74/40; 110/236; 110/346; 137/309; 251/229; 251/251; 422/175; 432/181; 432/182

[58] Field of Search ..... 251/229, 251; 74/40, 74/44; 110/233, 236, 346; 137/309; 422/175; 432/181, 182

[56] References Cited

U.S. PATENT DOCUMENTS

| | | | |
|---|---|---|---|
| 4,470,806 | 9/1984 | Greco | 432/182 |
| 4,821,998 | 4/1989 | Legille et al. | 251/229 X |
| 4,943,231 | 7/1990 | Jenkins et al. | 432/182 X |
| 4,961,908 | 10/1990 | Pennington et al. | 422/175 X |

*Primary Examiner*—Edward G. Favors
*Attorney, Agent, or Firm*—Dykema Gossett

[57] ABSTRACT

A unique valve mechanism for opening and closing inlet, outlet, and purge valves in a regenerative incinerator is disclosed. The valves are mechanically opened and closed by a cam arrangement which insures proper timing, and optimal volume flow through the valves during each cycle. Further, a method of the present invention begins the purge mode while the inlet valve is opened, and completes it after the outlet valve has opened. This reducing the required time for each cycle of operation.

5 Claims, 3 Drawing Sheets

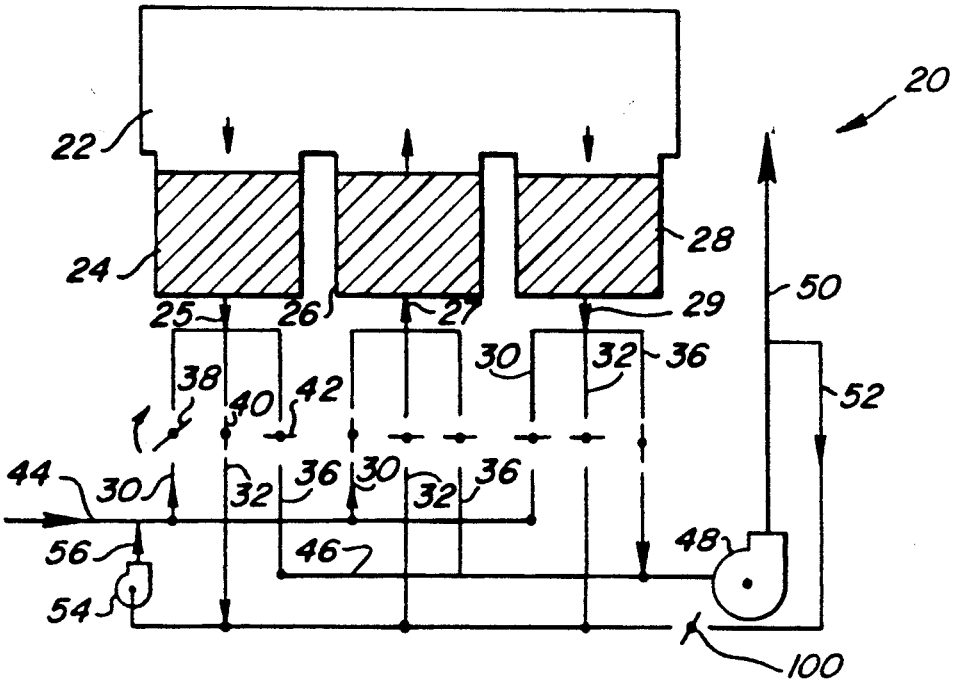
Fig-1
Fig-2
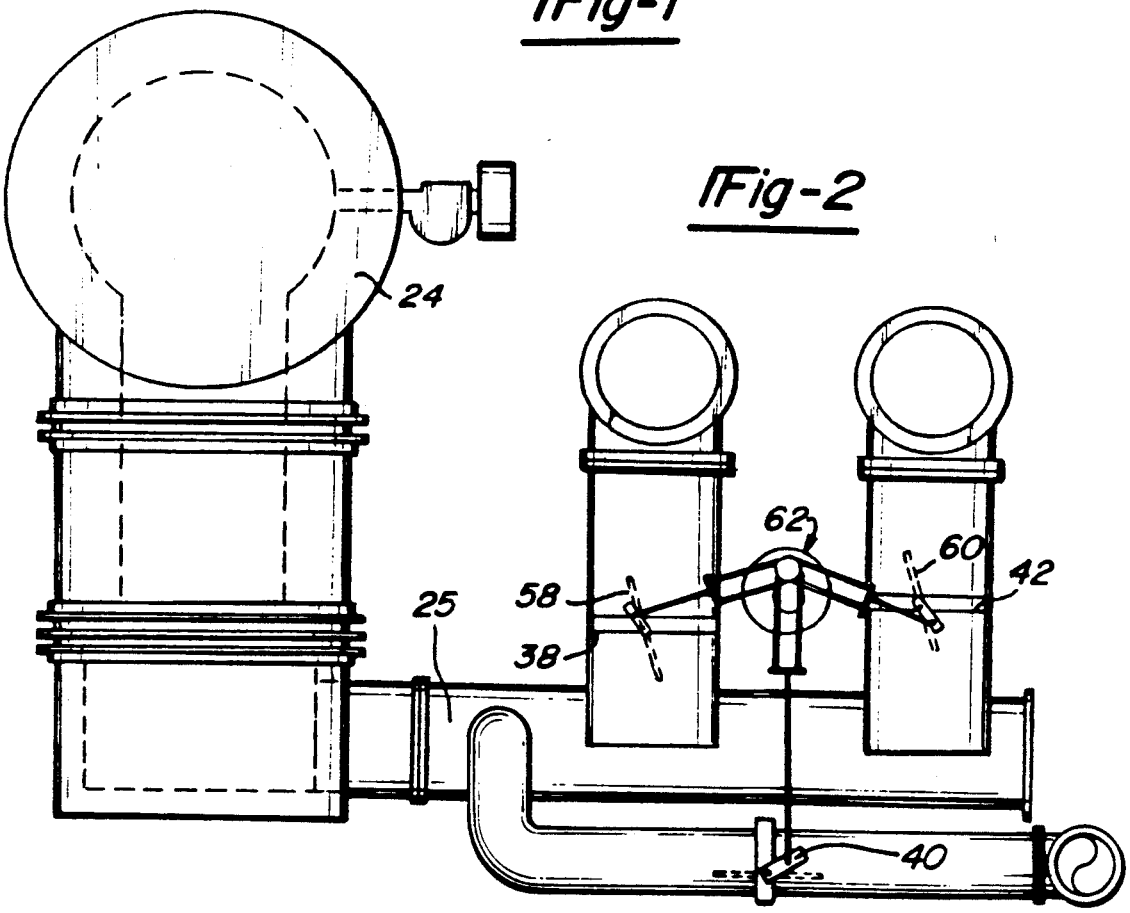

VALVE ACTUATION MECHANISM FOR INCINERATOR

This is a continuation of co-pending application Ser. No. 07/728,198 filed on Jul. 10, 1991 U.S. Pat. No. 5,129,332.

BACKGROUND OF THE INVENTION

This application in general relates to a valve arrangement for a regenerative incinerator.

Incinerators are known in the prior art which include a plurality of regeneration heat exchange chambers leading into a combustion chamber. The heat exchange chambers each move cyclically through inlet, purge and outlet modes. In an inlet mode cool air to be cleaned, containing impurities such as paint solvents, is lead into a combustion chamber through one of the heat exchange chambers. This air to be cleaned will be referred to as "dirty" air for the purposes of this application. As air is entering the combustion chamber through one heat exchange chamber, a second heat exchange chamber in an outlet mode is receiving hot clean air which had previously been combusted in the combustion chamber. The cool and hot air passes cyclically through the heat exchange chambers, alternatively heating and cooling them. In this way, the cool air leading into the combustion chamber is preheated, increasing thermal efficiency.

This type of incinerator operates continuously with at least one chamber in an inlet mode sending preheated air into the combustion chamber, and at least one chamber in an outlet mode receiving hot air from the combustion chamber. In this way relatively large volumes of air are cleaned.

More recently, the use of a purge mode has been used after the inlet mode, and before the beginning of the outlet mode. The purge mode ensures that any dirty air left in the heat exchange chamber from the previous inlet mode will be removed before the outlet mode begins. If dirty air remained in the heat exchange chamber, that air could move with the outlet air into a downstream destination, such as atmosphere, reducing combustion efficiency.

The prior art incinerators typically have at least three heat exchange chambers. There are valves for each of the three modes leading into and out of each heat exchange chamber. Thus, there are at least nine valves, and valve control becomes relatively complicated.

Typically, the prior art has used electronic or hydraulic controls to actuate valves. Such systems may be less efficient than desired. It is somewhat difficult to properly time the opening and closing of the valves associated with each of the several heat exchange chambers and maintain steady inlet pressures. It is important to insure that no dirty air reaches the outlet for optimum combustion efficiency. For this reason when a purge cycle is used the timing of each mode of operation, during each cycle, for each chamber, is critical. Further, hydraulically opened and closed valves tend to restrict the flow of the fluid through the valves severely once they begin to close, but then taper slowly to zero. Due to this, the valves are restricted resulting in low flow percentages for a relatively long portion of the cycle. They are somewhat slow to respond, and result in flow peaks rather than smooth operation. Each of these problems is undesirable.

Further, the prior art systems have typically ended an inlet cycle and then had a pause or delay before beginning the purge or outlet cycles. This results in overly long cycling time, and reduced volume flows for a given time period.

Various types of cams and other mechanical actuation systems have been used to open and close inlet and outlet valves in this type of regenerative incinerator. Further, mechanically operated means which have utilized eccentrically mounted secondary shafts driven by a main shaft have been used to actuate inlet and outlet valves. Mechanically operated means have not been used to open and close valves associated with the inlet, outlet, and purge lines. As discussed above, the timing of the purge mode is critical.

Further, the prior art systems have typically segregated the modes between inlet, outlet and purge cycles. These systems have waited until the inlet valve is completely closed before beginning the purge mode. Also, they have waited till the purge mode ended before beginning the outlet mode. With the use of the prior art hydraulically actuated valves this may take a relatively long period of time increasing the cycle time and reducing the flow volume for a given period of time.

SUMMARY OF THE INVENTION

A disclosed embodiment of the present invention uses mechanical means to open and close valves associated with inlet, outlet, and purge lines for each of several heat exchange chambers. By using mechanically actuated valves in this fashion, the timing between the opening of each valve is more accurate. Since one can rely upon mechanical actuation to insure each valve opens and closes in a proper timed sequence one can achieve greater air flows and quicker response times. Further, the operation is much smoother than in the prior art.

In a disclosed embodiment of the present invention, the inlet valve on each heat exchange chamber is opened for approximately 180° of each cycle, with the outlet valves opened for the remaining 180°. A purge mode begins while the inlet valve is open, and may end slightly after the opening of the outlet valve. Thus, the purge cycle is occurring while the inlet valve is closing and while the outlet valve is opening. The periods when the valves are opening or closing is a low flow period, and by using that time for the purge mode the present invention increases flow volume for that given period of time.

Since the present invention does not wait till the inlet valve trails off to zero flow before switching to the purge mode higher volume, quicker response time, and smoother operation is achieved. The same is true for opening the outlet valve near the end of the purge mode.

In a disclosed embodiment a fan alternatively pulls air from the outlet line or from the combustion chamber through any heat exchange chamber in a purge mode, and having an open purge valve. The purge fan supplies that air to the main inlet line from which it is sent to a heat exchange chamber in an inlet mode to be combusted. In this way the purge mode removes dirty air before the outlet mode of that heat exchange chamber begins. Since the purge air is directed into the inlet, the main system fan need not be sized to handle the additional volume of purge air.

The inlet line leading into a chamber having an open purge line will also have an open inlet valve for a portion of the time the purge valve is opened. A second inlet line will have already opened presenting a lower resistance to the flow. The inlet line leading into the chamber having the opened purge valve will have a high resistance to flow, since the purge line is sucking air out of the chamber. In this way the valving system of the prior art allows the purging of the chambers to begin without requiring the inlet to be completely closed. The cycle time now can be reduced since one need not wait for the inlet valve to close before beginning the purge mode. This increases the volume flow through the system, and also results in smoother operation. Further, the system size may be reduced.

In another feature of the present invention, the valve actuation mechanism includes a secondary planetary shaft eccentric to the main drive shaft associated with each heat exchange chamber. This shaft receives a hook-like bracket from each valve. The bracket is received around the shaft which slides within the bracket during the periods when it is not desired to move the valve. The shaft's movement through its cycle results in brackets for the appropriate valves being moved to open the valves at the proper time. This positive opening and closing of the valves by mechanical means insures that the timing between the valves is proper.

These and other features of the present invention are best understood from the following specifications and drawings, of which the following is a brief description.

BRIEF DESCRIPTION OF THE DRAWINGS

FIG. 1 is a largely schematic view of a incinerator according to present invention.

FIG. 2 is a plan view of one heat exchange chamber in the system illustrated in FIG. 1.

DETAILED DESCRIPTION OF A PREFERRED EMBODIMENT

Figures 3A, 3B:
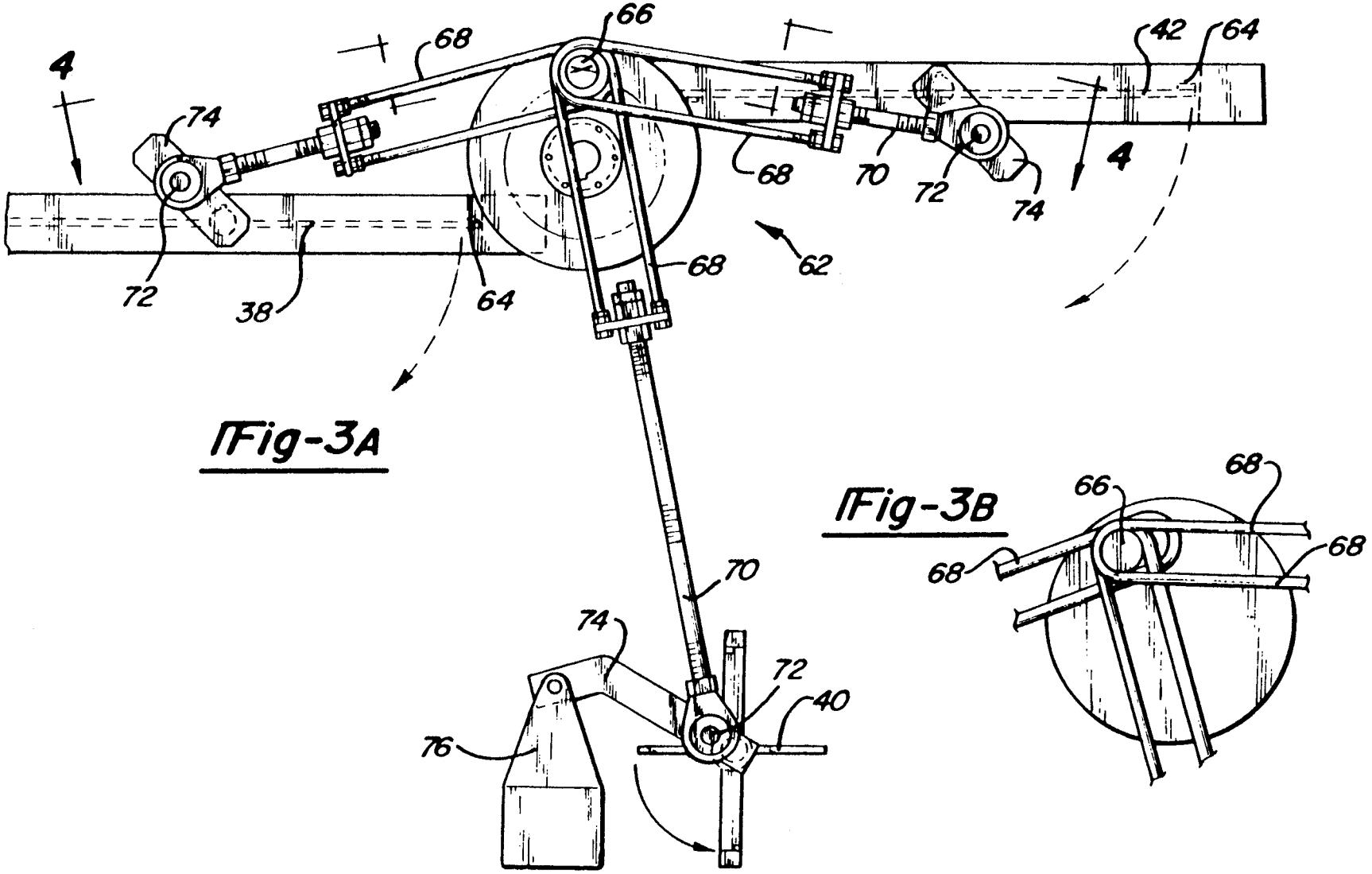
FIG. 3A is a view of the inventive valve actuation mechanism.
FIG. 3B is an enlarged partial view of the mechanism shown in FIG. 3A.

FIG. 1 is a schematic view of regenerative incinerator 20. A combustion chamber 22 alternately receives air and directs air into several heat exchange chambers 24, 26 and 28. Chambers 24, 26 and 28 include a known heat exchange medium. Line 25 leads into and out of chamber 24, line 27 into and out of chamber 26, and line 29 into and out of chamber 29. Inlet line 30, purge line 32 and outlet line 36 are selectively communicated to line 25. Valve 38, 40 and 42 are placed on lines 30, 32 and 36, respectively, and open and close in timed sequence to control flow into and out of chamber 24 through line 25. Chambers 26 and 27 include similar flow structure.

The air leading into system 20 flows from main inlet line 44 into the several inlet lines 30. The air is dirty, or laden with impurities, and is to be cleaned in combustion chamber 22. Line 46 leads to outlet fan 48, which in turn leads to a downstream use 50, which may be atmosphere. A purge tap 52 leads to purge fan 54, and through line 46 to main inlet line 44. Purge tap 52 also communicates with purge lines 36 leading to each line 25, 27, and 29. In FIG. 1, chamber 24 is shown after the end of an inlet mode and during a purge mode. Valve 38 is closing, and purge valve 40 is opened. Outlet valve 42 is closed.

Damper 100 is disposed on purge tap 52 and is weight biased to a closed position. Fan 54 is constantly driven during operation of system 20. When no purge valves 40 are opened, the suction from fan 54 overcomes the bias closing damper valve 100, such that valve 100 opens. At that time flow from purge tap 52 can pass into fan 54. This ensures that the volume flow in this system 20 through inlet line 44 will remain relatively constant.

Chamber 26 is in an inlet mode, with its inlet valve open and, and its purge and outlet valves closed. Chamber 28 is in its outlet mode with its outlet valve open and its inlet and purge valves closed. The chambers move cyclically between inlet and outlet modes, with a purge mode occurring between the inlet and the outlet mode. The purge ensures that dirty air in chambers 24, 26 and 28 is replaced with clean air prior to the beginning of the outlet mode. The outlet mode delivers air to a downstream user, which may be atmosphere, and thus it becomes important that no dirty air remain in the heat exchange chamber when the outlet mode begins.

The disclosed purge mode begins while the inlet valve is still opened. As shown in FIG. 1, the inlet valve on chamber 24 is not yet closed and the purge mode has begun. The inlet mode is still at a large flow capacity when the purge mode begins. It is not necessary to completely close the inlet valve prior to beginning the purge. This reduces cycling time and increases volume flow. Further, it insures smoother operation.

As shown in FIG. 1, even though inlet valve 38 on chamber 24 is open, flow from inlet line 42 does not reach line 25. Instead, purge fan 54 pulls air from chamber 22, through chamber 24, line 25, and into fan 54. This flow presents a great resistance to flow from inlet line 30 into line 25. There will be much less resistance to flow through inlet 30 leading into line 27 on chamber 26. Thus, the inlet air flows into chamber 26. Purge fan 54 directs air through line 56 into line 44, and through chamber 26 for combustion.

At least three heat exchange chambers are preferably used. The inlets and outlets are out of phase from each other by an angle of 360°/N, wherein N is the number of heat exchange chambers. In FIG. 1, the inlet line 30 on chamber 24 would be 120° out of phase from the inlet valve on chamber 26. The same would be true for the outlet modes.

As shown in FIG. 2, system 20 includes a single valve actuation shaft 62 which controls valves 38, 40 and 42 on all three chambers. The valves are moved from the closed position to an open position, 58 and 60, shown in phantom.

As shown in FIG. 3A, valve actuation mechanism 62 opens and closes valves 38, 40 and 42. Valves 38 and 42 are shown closed and abutting stops 64. Purge valve 40 is open. This arrangement of valves preferably only occurs at 180° point of the cycle. Inlet valve 38 has moved smoothly to open and then close in 180° of rotation of shaft 62. Outlet valve 42 then opens. The purge valve is opened for approximately 60° during the time inlet valve 38 is closing, and preferably slightly overlapping the opening of outlet valve 42.

To open and close valves 38, 40 and 42 a secondary shaft 66, which is eccentrically mounted relative to shaft 62 receives a U-shaped bracket 68 from each of the valves. An adjustable bolt assembly 70 is connected between bracket 68 and pivot point 72 which moves flap valve actuation member 74. Weight 76 biases the valves to a closed position when they are not actuated to the open position by the actuation member 74. As shaft 66 moves, it pulls brackets 68 such that values 38, 40 and 42 open and close in proper sequence. A separate shaft 66 is used for each heat exchange chamber, with the shaft positions being spaced to control valve timing.

As shown in FIG. 3A, shaft 66 abuts the end of brackets 68 for each valve 38, 40 and 42. When shaft 66 abuts the end of a bracket 68, then the respective valve is going to be moved to an open position, or will be at an open position. When shaft 66 does not abut the end of bracket 68, then shaft 66 slides within bracket 68, and weights 76 bias the valve to a closed position. In a position shown in FIG. 3A, inlet valve 38 has just closed. Thus, shaft 66 is still at the end of bracket 68, but will be sliding within bracket 68 away from that end. Shaft 66 has just reached the end of bracket 68 for outlet valve 42, which will soon begin opening. Purge valve 40 is open, and shaft 66 will remain at the end of bracket 68, continuing to hold purge valve 40 open for an additional portion of the cycle.

As shown in FIG. 3B, shaft 66 has rotated slightly counter-clockwise from the position shown in 3A. Bracket 68 associated with valve 42 has moved further to the left, opening outlet valve 42. Bracket 68 associated with purge valve 40 has rotated further, and valve 40 has begun moving towards a closed position. Bracket 68 associated with inlet valve 38 has not moved. Instead shaft 66 has slid within bracket 68, and valve 38 remains closed. In this way, proper timing between the various valves is achieved. The use of the mechanical actuation for the valves insures that the valves are opened and closed when necessary. This prevents any dirty air from being in a heat exchange chamber when an outlet valve is opened.

Figure 4:
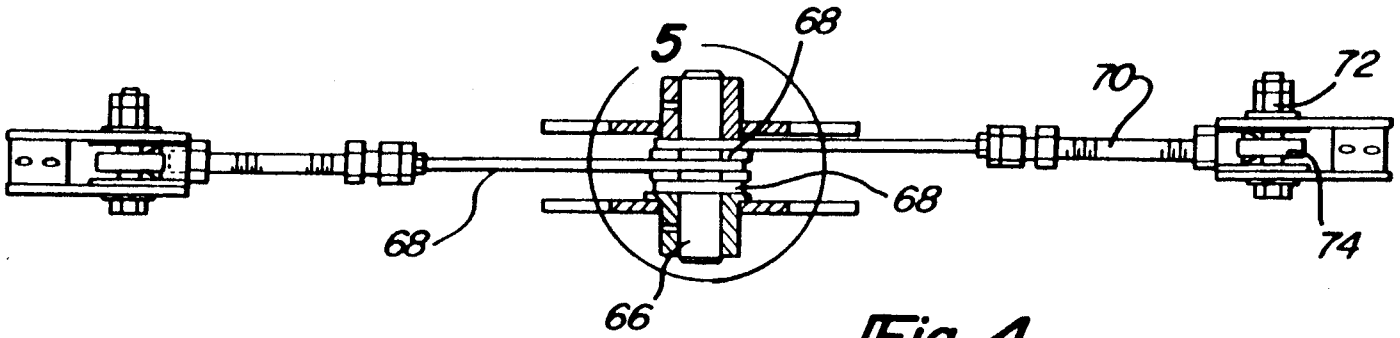
FIG. 4 is a view along line 4—4 as shown in FIG. 3A.

As shown in FIG. 4, valve actuation mechanism for one heat exchange chamber includes shaft 66 which receives brackets 68 associated with each of the several valves. Bolt 70 is adjustably mounted within bracket 68. By adjusting the length of bolt 70 one controls the amount of time the valve is opened. This allows the easy adjustment of the period each valve is open. As shown in FIG. 3A, a relatively long bolt 70 is used with the purge valve 40, compared to shorter bolts 70 for inlet valve 38 and outlet valve 42. This reduces the time the purge valve 40 is open during each cycle.

Figure 5:
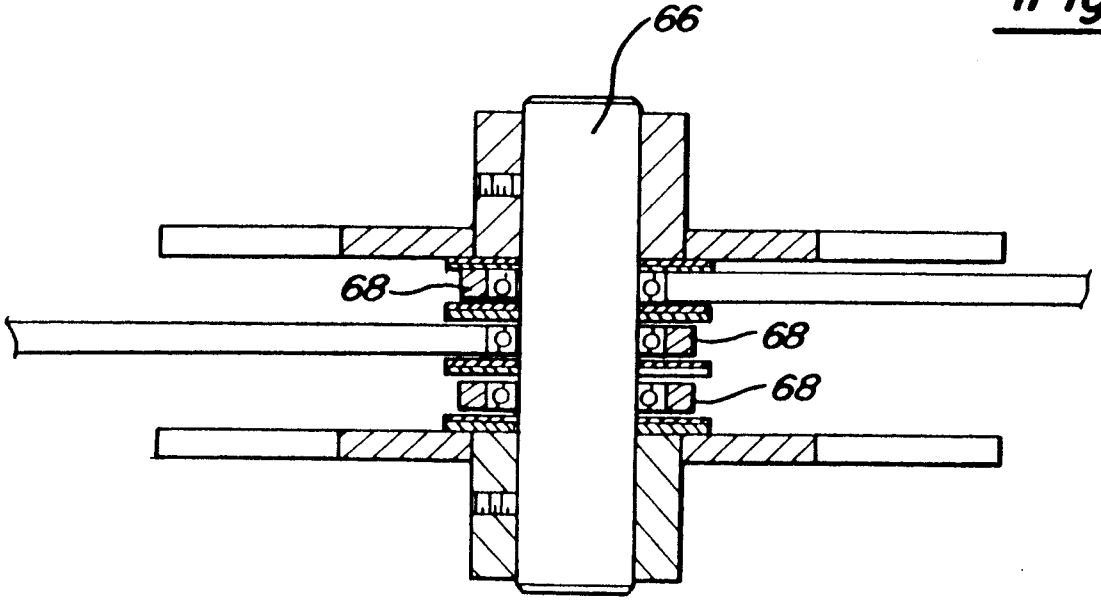
FIG. 5 is a view along line 5 as shown in FIG. 4.

As shown in FIG. 5, pin 66 is received with bearings between each bracket 68. This ensures smooth operation of the valve actuation mechanism 62.

The purge mode typically has volume flows of about 10% the peak inlet and outlet flows. Other operational details of this system are disclosed generally in U.S. Pat. No. 4,470,806, the disclosure of which is adopted by reference.

A preferred embodiment of the present invention has been disclosed, however, a worker of ordinary skill in the art would recognize that certain modifications would come within the scope of this invention. For that reason the following claims should be studied in order to determine the true scope and content of this invention.

I claim:

1. A valve actuation structure comprising:

a rotating member;

an eccentrically mounted actuation portion on said rotating member;

a plurality of actuation structures selectively actuated by said actuation portion, and connected to a plurality of valves for actuation of respective ones of said valves; and means associated with said actuation structures to allow said actuation portion to move relative to certain of said actuation structures at periods on each rotation of said rotating member when it is not desired for said valves associated with said certain actuation structures to be actuated.

2. A valve actuation structure as recited in claim 1, wherein said actuation structures include generally U-shaped members, said actuation portion being an eccentrically mounted pin, with said pin being slidable within said U-shaped members during periods of the cycle of said valve system such that said valves are not actuated.

3. A regenerative incinerator comprising:

a combustion chamber;

a plurality of heat exchange chambers leading into said combustion chamber, said heat exchange chambers having an inlet line leading to a source of air to be cleaned and an outlet line leading to a downstream destination for clean air;

an inlet valve disposed on each of said inlet lines and an outlet valve disposed on each of said outlet lines;

a valve actuation structure for each of said inlet and said outlet valves including a rotating member, an eccentrically mounted actuation portion on said rotating member, a plurality of actuation structures selectively actuated by said actuation portion and each connected to one of said inlet and outlet valves for actuation of respective ones of said valves; and means associated with said actuation structures to allow said actuation portion to move relative to certain of said actuation structures at periods on each rotation of said rotating member when it is not desired for the respective valve associated with the respective actuation structure to be actuated.

4. A regenerative incinerator as recited in claim 3, wherein a purge line also leads into said heat exchange chamber and a purge valve is associated with said purge line, there being an actuation structure associated with each of said purge valves, and said actuation portion also moving relative to said purge valve actuation structures at period on each rotation of said rotary member when it is not desired for said purge valves associated with said actuation structures to be actuated.

5. A regenerative incinerator as recited in claim 3, wherein said actuation structures include generally U-shaped members and said actuation portion being an eccentrically mounted pin, with said pin being slidable within said U-shaped members during periods of each rotation of said rotating member such that respective ones of said valves are not actuated.

* * * * *